US011764477B2

(12) United States Patent
Lin

(10) Patent No.: US 11,764,477 B2
(45) Date of Patent: Sep. 19, 2023

(54) ANTENNA APPARATUS

(71) Applicant: RichWave Technology Corp., Taipei (TW)

(72) Inventor: Shih-Kai Lin, Taipei (TW)

(73) Assignee: RichWave Technology Corp., Taipei (TW)

( * ) Notice: Subject to any disclaimer, the term of this patent is extended or adjusted under 35 U.S.C. 154(b) by 0 days.

(21) Appl. No.: 17/565,457

(22) Filed: Dec. 30, 2021

(65) Prior Publication Data

US 2023/0208042 A1 Jun. 29, 2023

(30) Foreign Application Priority Data

Dec. 24, 2021 (TW) ..... 110148774

(51) Int. Cl.
*H01Q 13/18* (2006.01)
*H01Q 9/04* (2006.01)
*H01Q 19/02* (2006.01)

(52) U.S. Cl.
CPC ..... *H01Q 13/18* (2013.01); *H01Q 9/045* (2013.01); *H01Q 19/025* (2013.01)

(58) Field of Classification Search
CPC ..... H01Q 9/045; H01Q 9/0457
See application file for complete search history.

(56) References Cited

U.S. PATENT DOCUMENTS 6,075,485 A 6/2000 Lilly et al.
6,166,692 A 12/2000 Nalbandian et al.
6,975,276 B2 12/2005 Brown
8,988,299 B2 3/2015 Kam et al.
9,323,877 B2 4/2016 Ng et al.
9,515,365 B2 12/2016 McCormack et al.
10,170,839 B2 1/2019 Xue et al.
(Continued)

FOREIGN PATENT DOCUMENTS

CN 110224230 9/2019
TW 201123607 7/2011
(Continued)

OTHER PUBLICATIONS

"Notice of allowance of Taiwan Counterpart Application", dated Feb. 8, 2023, p. 1-p. 3.

*Primary Examiner* — Daniel Munoz
(74) *Attorney, Agent, or Firm* — JCIPRNET

(57) ABSTRACT

An antenna apparatus is provided. The antenna apparatus includes a cavity element, a radiating element, and a feeding element. The cavity element includes an opening. The radiating element is located in the opening and is disposed at a conductive layer. An outline of the radiating element and the opening form a surround slot. An imaginary rectangle has four sides respectively abutted against an external outline of the surround slot. The feeding element is disposed at another parallel conductive layer. The feeding element includes two sections. There is a coupling spacing is between a section and the radiating element to feed into the radiating element through electric field coupling. A tail end of the section is an open circuit. Another section is an initial section of the feeding element inserted into the opening. There is a shifting spacing between the another section and a central line of the imaginary rectangle.

21 Claims, 13 Drawing Sheets

(56) References Cited

U.S. PATENT DOCUMENTS

| | | | | |
|---|---|---|---|---|
| 10,998,633 | B2 | 5/2021 | Nasimuddin et al. | |
| 2008/0218418 | A1* | 9/2008 | Gillette | H01Q 9/045 343/700 MS |
| 2016/0028162 | A1* | 1/2016 | Ou | H01Q 9/0457 343/905 |
| 2021/0242601 | A1* | 8/2021 | Johansson | H01Q 9/0414 |

FOREIGN PATENT DOCUMENTS

| | | |
|---|---|---|
| TW | 201125211 | 7/2011 |
| TW | 201935769 | 9/2019 |
| TW | 201935770 | 9/2019 |
| TW | 714410 | 12/2020 |

* cited by examiner

11

ANTENNA APPARATUS

CROSS-REFERENCE TO RELATED APPLICATION

This application claims the priority benefit of Taiwan application serial no. 110148774, filed on Dec. 24, 2021. The entirety of the above-mentioned patent application is hereby incorporated by reference herein and made a part of this specification.

BACKGROUND

Technical Field

The disclosure relates to an antenna technology, and particularly relates to a non-narrowband antenna apparatus.

Description of Related Art

The antenna design affects the antenna performance. The bandwidth is one of the indicators of antenna performance. In order to meet non-narrowband requirements, most antenna architectures are complex and difficult to design.

SUMMARY

The disclosure provides an antenna apparatus. The antenna apparatus includes (but is not limited to) a cavity element, a radiating element, and a feeding element. The cavity element includes an opening. The radiating element is located in the opening and is disposed at a conductive layer. An outline of the radiating element and the opening form a surround slot. An external outline of the surround slot is configured to define an imaginary rectangle, and the imaginary rectangle has four sides respectively abutted against the external outline of the surround slot. The feeding element is disposed at another parallel conductive layer. The feeding element includes two sections. There is a coupling spacing between one section of the two sections and the radiating element to feed into the radiating element through electric field coupling. A tail end of the section is an open circuit. Another section is an initial section of the feeding element inserted into the opening. There is a shifting spacing between the another section and a central line of the imaginary rectangle.

In order for the features and advantages of the disclosure to be more comprehensible, the following specific embodiments are described in detail in conjunction with the accompanying drawings.

DETAILED DESCRIPTION OF DISCLOSED EMBODIMENTS

Figure 1A:
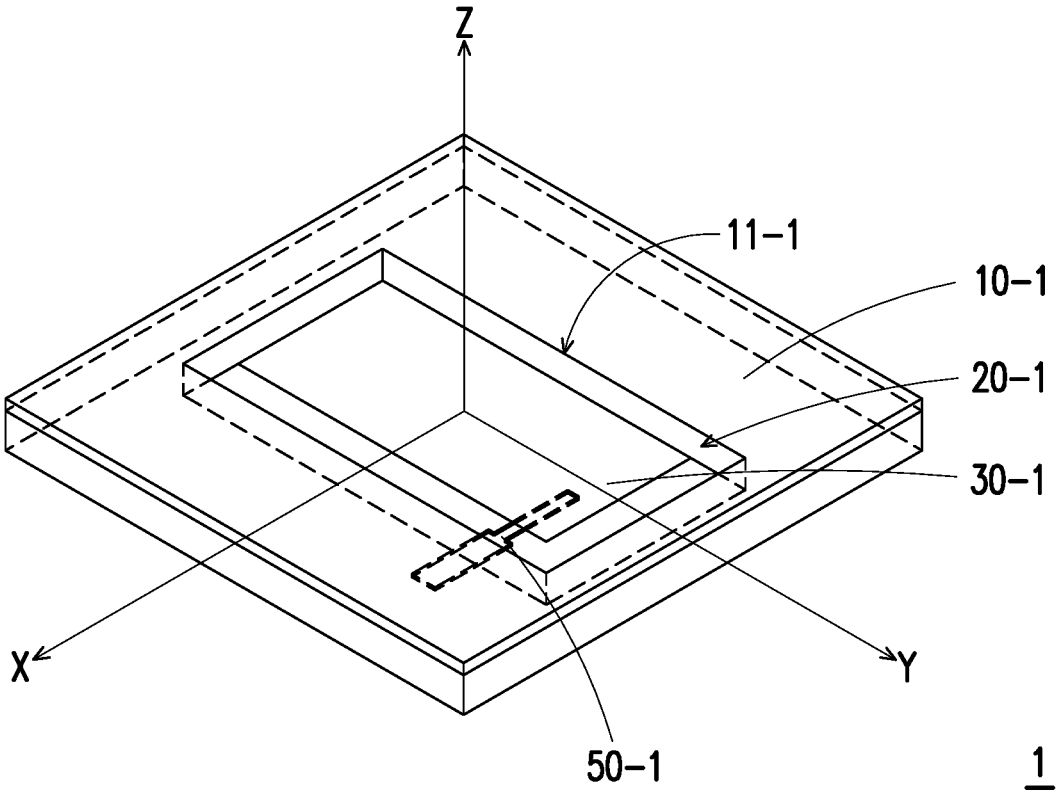
FIG. 1A is a perspective view of an antenna apparatus according to Embodiment 1 of the disclosure.
Figure 1B:
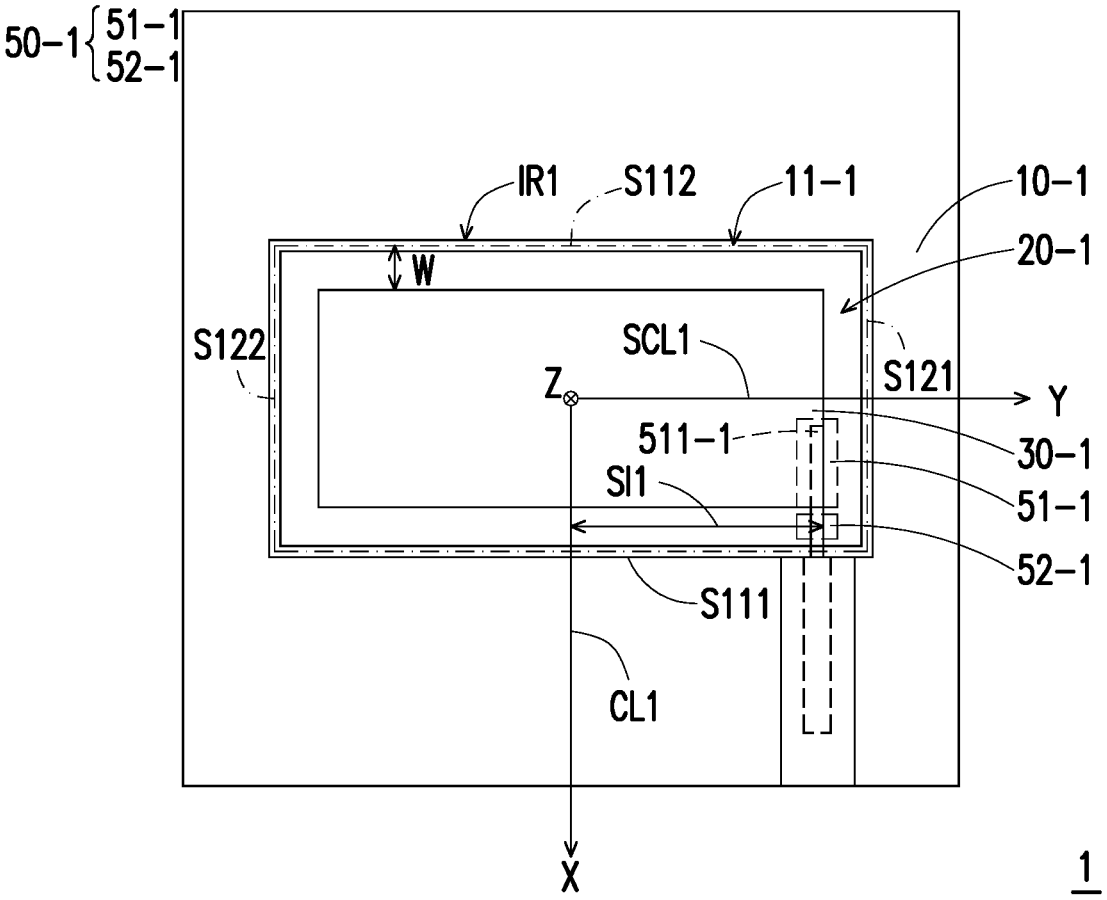
FIG. 1B is a top view of the antenna apparatus according to Embodiment 1 of the disclosure.
Figure 1C:
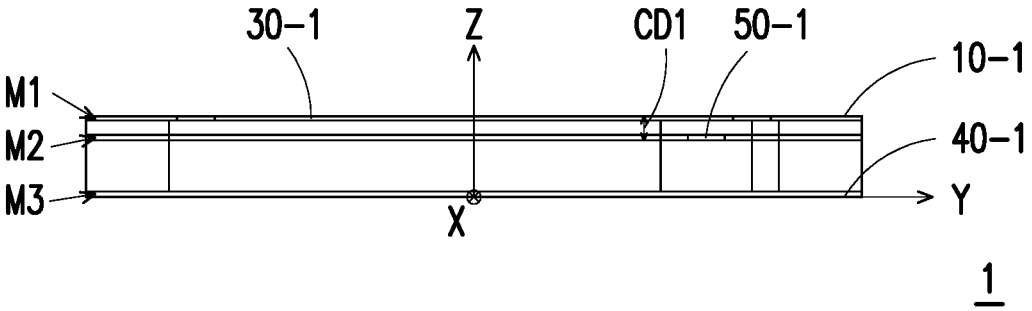
FIG. 1C is a side view of the antenna apparatus according to Embodiment 1 of the disclosure.

FIG. 1A is a perspective view of an antenna apparatus 1 according to Embodiment 1 of the disclosure, FIG. 1B is a top view of the antenna apparatus 1 according to Embodiment 1 of the disclosure, and FIG. 1C is a side view of the antenna apparatus 1 according to Embodiment 1 of the disclosure. Please refer to FIG. 1A to FIG. 1C, the antenna apparatus 1 includes a cavity element 10-1, a radiating element 30-1, and a feeding element 50-1.

The cavity element 10-1 is a cavity including an opening 11-1. FIG. 1A takes a rectangular cavity as an example, but the appearance is not limited thereto. The opening 11-1 is rectangular. From the perspective of FIG. 1C (for example, a Y-Z plane), a top side of the cavity element 10-1 abuts a conductive layer M1, and a bottom side of the cavity element 10-1 abuts a conductive layer M3. It should be noted that conductive layers M1, M2, and M3 are parallel to an X-Y plane. The conductive layer M2 is located between the conductive layer M1 and the conductive layer M3.

The radiating element 30-1 may be a patch, a microstrip, or other radiators. The radiating element 30-1 is located in the opening 11-1 and is disposed at the conductive layer M1. A geometrical shape of an outline of the radiating element 30-1 is the same as the opening 11-1. That is, the radiating element 30-1 is rectangular. From the perspective of FIG. 1B, an area of the radiating element 30-1 is smaller than an area of the opening 11-1. In addition, the outline of the radiating element 30-1 and the opening 11-1 form a surround slot 20-1 (also referred to as a slot-ring).

From the perspective of FIG. 1C, the feeding element 50-1 is disposed at the conductive layer M2. The feeding element 50-1 may be a microstrip line, a stub, or other transmission conductors.

From the perspective of FIG. 1B, the feeding element 50-1 includes (but is not limited to) sections 51-1 and 52-1. The sections 51-1 and 52-1 form a straight stub.

From the perspective of FIG. 1C, a part of the feeding element 50-1 is located below the radiating element 30-1. In other words, regions of the sections 51-1 and 52-1 projected onto the conductive layer M1 in a vertical direction of the conductive layer M2 partially overlaps with the radiating element 30-1. For example, the entire section 51-1 is located directly below the radiating element 30-1. There is a coupling spacing CD1 between the section 51-1 and the radiating element 30-1. Thereby, the feeding element 50-1 may feed a radio signal into or out of the radiating element 30-1 through an electric field coupling manner. A tail end of the section 51-1 is an open circuit.

From the perspective of FIG. 1B, the section 52-1 is an initial section of the feeding element 50-1 inserted into the opening 11-1. In addition, there is a shifting spacing SI1 between the section 52-1 and a central line CL1 of an imaginary rectangle IR1. In other words, the feeding element 50-1 is not for centered feeding. It is worth noting that an external outline of the surround slot 20-1 may be configured to define the imaginary rectangle IR1, and the imaginary rectangle IR1 is configured to define a central line of the surround slot 20-1. The imaginary rectangle IR1 has four sides (for example, opposite sides S111, S112, S121, and S122), and the four sides are respectively abutted against the external outline of the surround slot 20-1. The imaginary rectangle IR1 is the smallest rectangle that may cover the external outline of the surround slot 20-1 (that is, an outline of the opening S11-1) on the X-Y plane. That is, the rectangle with the smallest area among all rectangles that may cover the external outline of the surround slot 20-1. In other words, a region of the imaginary rectangle IR1 projected onto the conductive layer M1 may cover the external outline of the surround slot 20-1 and has the smallest area. For example, assuming that the external outline of the surround slot 20-1 is also rectangular, the imaginary rectangle IR1 will also coincide with the rectangle of the external outline of the surround slot 20-1. Assuming that the external outline of the surround slot 20-1 is also an ellipse, lengths of a long side and a short side of the imaginary rectangle IR1 will also be equal to lengths of a long axis and a short axis of the ellipse.

In an embodiment, from the perspective of FIG. 1B, the imaginary rectangle IR1 includes two opposite sides S111 and S112. The central line CL1 is formed at a center of any one of the opposite sides S111 and S112. That is, the central line CL1 is a perpendicular bisector of the opposite sides S111 and S112. The section 52-1 is inserted into the opening 11-1 from the opposite side S111, and a tail end 511-1 of the section 51-1 is not connected to the opposite side S112 (that is, an open circuit is formed). In an embodiment, the shifting spacing SI1 is greater than or equal to one-sixteenth of lengths of the opposite sides S111 and S112 to provide an appropriate non-narrowband range. For example, if the shifting spacing SI1 is increased from one-sixteenth of the lengths of the opposite sides S111 and S112 to one-quarter or more, the non-narrowband range provided by the antenna apparatus 1 will be increased from a dual-bandwidth range to a wideband range.

In an embodiment, from the perspective of FIG. 1B, a shortest linear distance W from the external outline of the surround slot 20-1 to an external outline of the radiating element 30-1 may define one or more widths of the surround slot 20-1. The largest width among the one or more widths of the surround slot 20-1 is less than half of the wavelength of the radio signal of the antenna apparatus 1. However, in other embodiments, the largest width among the one or more widths of the surround slot 20-1 may also be one-quarter of the wavelength, one-eighth of the wavelength, or other lengths.

In an embodiment, from the perspective of FIG. 1B, the imaginary rectangle IR1 further includes the opposite sides S121 and S122. The tail end 511-1 of the section 51-1 does not exceed the central line SCL1 of the imaginary rectangle IR1. The central line SCL1 is formed at a center of any one of the opposite sides S121 and S122. That is, the central line SCL1 is a perpendicular bisector of the opposite sides S121 and S122. In an embodiment, the lengths of the opposite sides S111 and S112 are greater than lengths of the opposite sides S121 and S122, that is, the section 52-1 may be inserted into the opening 11-1 by the long side (the opposite side S111) of the imaginary rectangle IR1, and the central line CL1 may be a perpendicular bisector of the long side of the rectangle IR1.

In another embodiment, from the perspective of FIG. 1B, the tail end 511-1 of the section 51-1 may exceed the central line SCL1 of the imaginary rectangle IR1, but the tail end 511-1 is still an open circuit (that is, not connected to the opposite side S112).

In addition, from the perspective of FIG. 1C, the antenna apparatus 1 further includes a ground part 40-1. The ground part 40-1 is disposed at the conductive layer M3 parallel to the conductive layer M1. In addition, the ground part 40-1 is located on the bottom side of the cavity element 10-1. In an embodiment, the cavity element 10-1 is a conductor, which is coupled to the ground part 40-1. In an embodiment, the opening 11-1 is defined by at least one conductive wall surrounding the radiating element 30-1. In another embodiment, the opening 11-1 is defined by multiple parallel conductive vias surrounding the radiating element 30-1. The feeding element 50-1 is, for example, configured to transmit the radio signal. The shortest distance between multiple conductors is less than or equal to half of the wavelength of the radio signal to provide acceptable signal isolation. In an embodiment, the shortest distance between the conductors is less than or equal to one-eighth of the wavelength of the radio signal to provide better signal isolation.

Figure 2A:
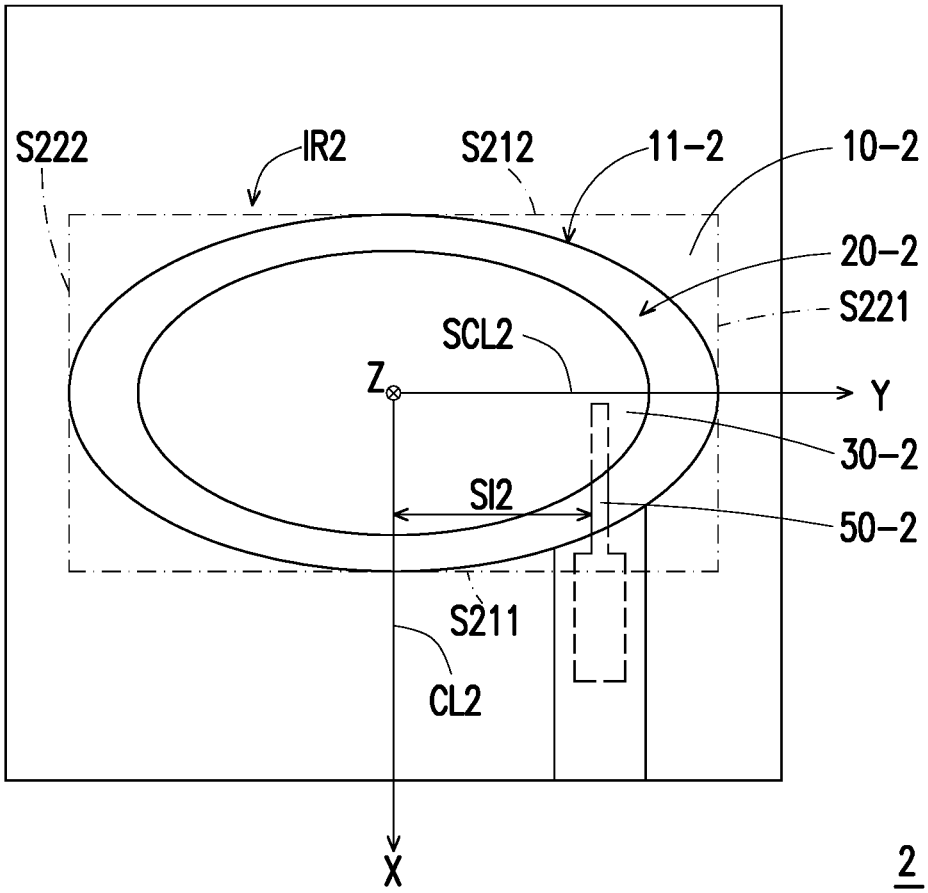
FIG. 2A is a top view of an antenna apparatus according to Embodiment 2 of the disclosure.
Figure 2B:
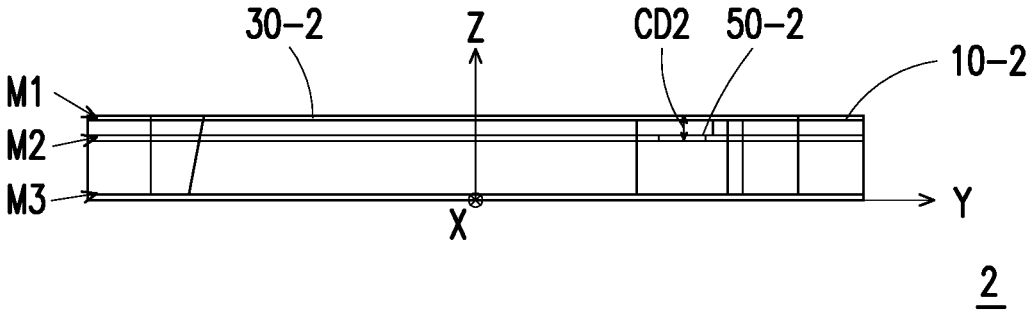
FIG. 2B is a side view of the antenna apparatus according to Embodiment 2 of the disclosure.

FIG. 2A is a top view of an antenna apparatus 2 according to Embodiment 2 of the disclosure, and FIG. 2B is a side view of the antenna apparatus 2 according to Embodiment 2 of the disclosure. Please refer to FIG. 2A and FIG. 2B. The antenna apparatus 2 includes a cavity element 10-2, a radiating element 30-2 (disposed at the conductive layer M1), and a feeding element 50-2 (disposed at the conductive layer M2). The difference from Embodiment 1 is that geometrical shapes of an outline of a radiating element 30-2 and an opening 11-2 are ellipses.

Similarly, the outline of the radiating element 30-2 and the opening 11-2 form a surround slot 20-2. There is a coupling spacing CD2 between the feeding element 50-2 and the radiating element 30-2. The two sets of opposite sides S211 and S212 and S221 and S222 of an imaginary rectangle IR2 are respectively abutted against an external outline of the surround slot 20-2. There is a shifting spacing SI2 between an initial section of the feeding element 50-2 and a central line CL2 of the imaginary rectangle IR2. In addition, a tail end of the feeding element 50-2 does not exceed a central line SCL2 of the imaginary rectangle IR2.

Figure 3:
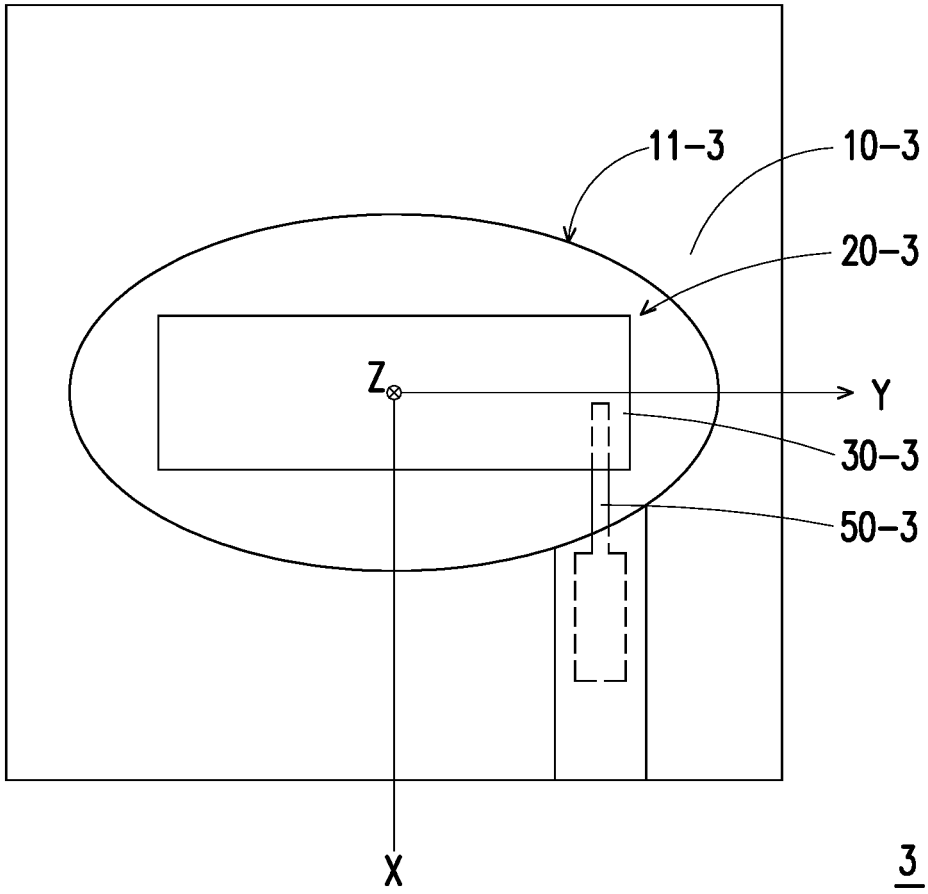
FIG. 3 is a top view of an antenna apparatus according to Embodiment 3 of the disclosure.

FIG. 3 is a top view of an antenna apparatus 3 according to Embodiment 3 of the disclosure. The antenna apparatus 3 includes a cavity element 10-3, a radiating element 30-3, and a feeding element 50-3. An outline of the radiating element 30-3 and an opening 11-3 form a surround slot 20-3. The difference from Embodiments 1 and 2 is that a geometrical shape of an outline of the radiating element 30-3 is different from the opening 11-3 of the cavity element 10-3. The geometrical shape of the outline of the radiating element 30-3 is rectangular, but the opening 11-3 is an ellipse.

Figure 4:
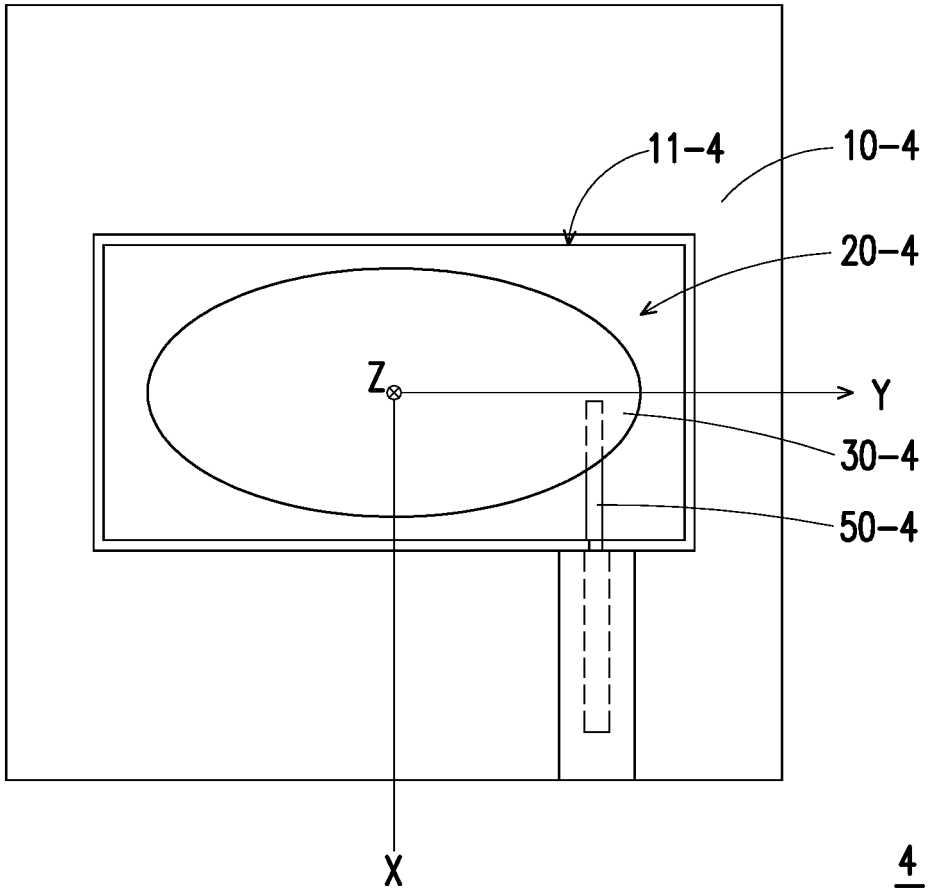
FIG. 4 is a top view of an antenna apparatus according to Embodiment 4 of the disclosure.

FIG. 4 is a top view of an antenna apparatus 4 according to Embodiment 4 of the disclosure. Please refer to FIG. 4. The antenna apparatus 4 includes a cavity element 10-4, a radiating element 30-4, and a feeding element 50-4. An outline of the radiating element 30-4 and an opening 11-4 form a surround slot 20-4. The difference from Embodiments 1 and 2 is that a geometrical shape of the outline of the radiating element 30-4 is different from the opening 11-4 of the cavity element 10-4. The geometrical shape of the outline of the radiating element 30-4 is an ellipse, but the opening 11-4 is rectangular.

Figure 5A:
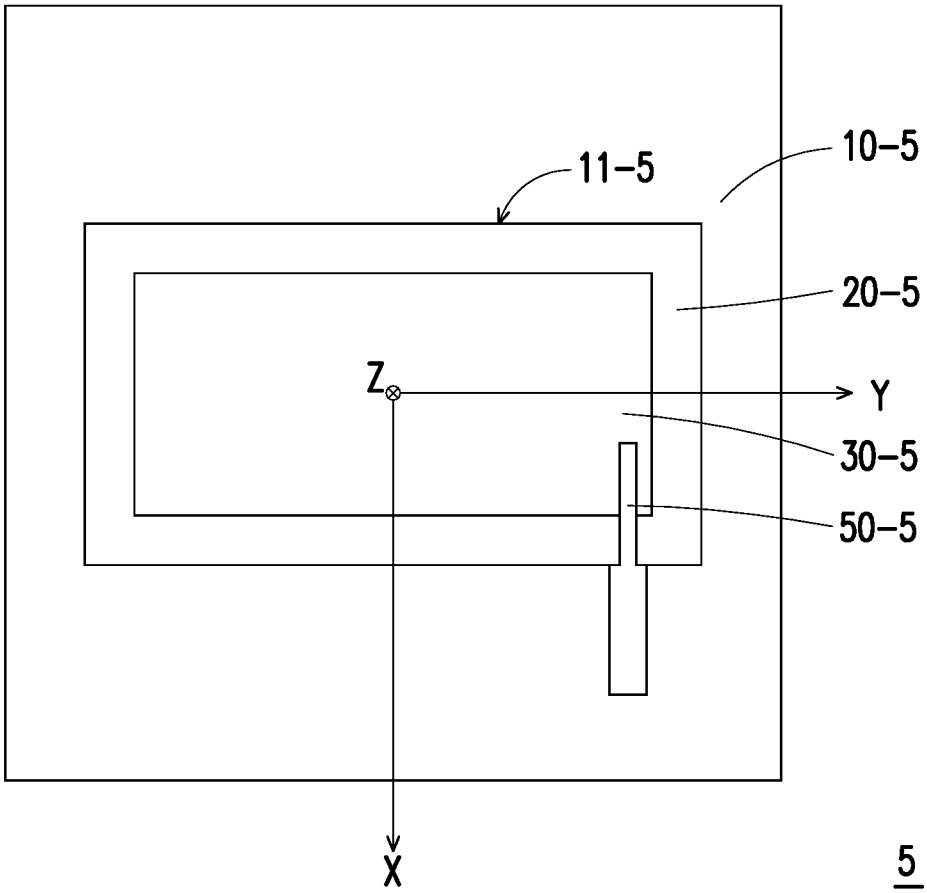
FIG. 5A is a top view of an antenna apparatus according to Embodiment 5 of the disclosure.
Figure 5B:
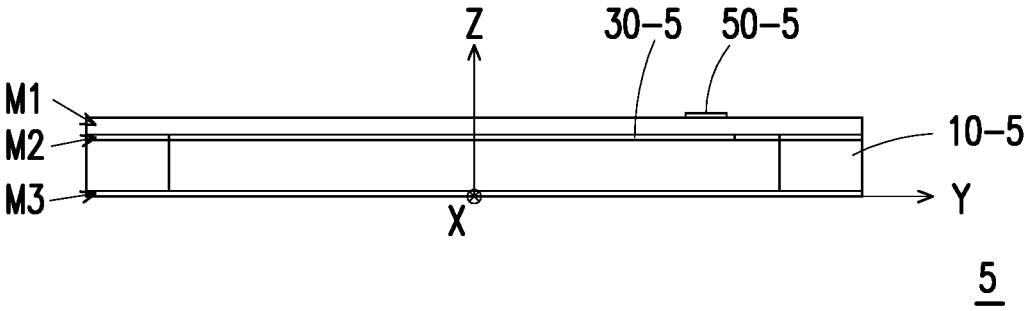
FIG. 5B is a side view of the antenna apparatus according to Embodiment 5 of the disclosure.

FIG. 5A is a top view of an antenna apparatus 5 according to Embodiment 5 of the disclosure, and FIG. 5B is a side view of the antenna apparatus 5 according to Embodiment 5 of the disclosure. Please refer to FIG. 5A and FIG. 5B. The antenna apparatus 5 includes a cavity element 10-5, a radiating element 30-5, and a feeding element 50-5. An outline of the radiating element 30-5 and an opening 11-5 form a surround slot 20-5. The difference from Embodiments 1 and 2 is that from the perspective of FIG. 5B, the radiating element 30-5 is disposed at the conductive layer M2. The feeding element 50-5 is disposed at the conductive layer M1. In other words, the conductive layer M2 where the radiating element 30-5 is at is located between the conductive layer M1 where the feeding element 50-5 is at and the conductive layer M3 on a bottom side of the cavity element 10-5. At this time, the feeding element 50-5 is located above the radiating element 30-5.

Figure 6A:
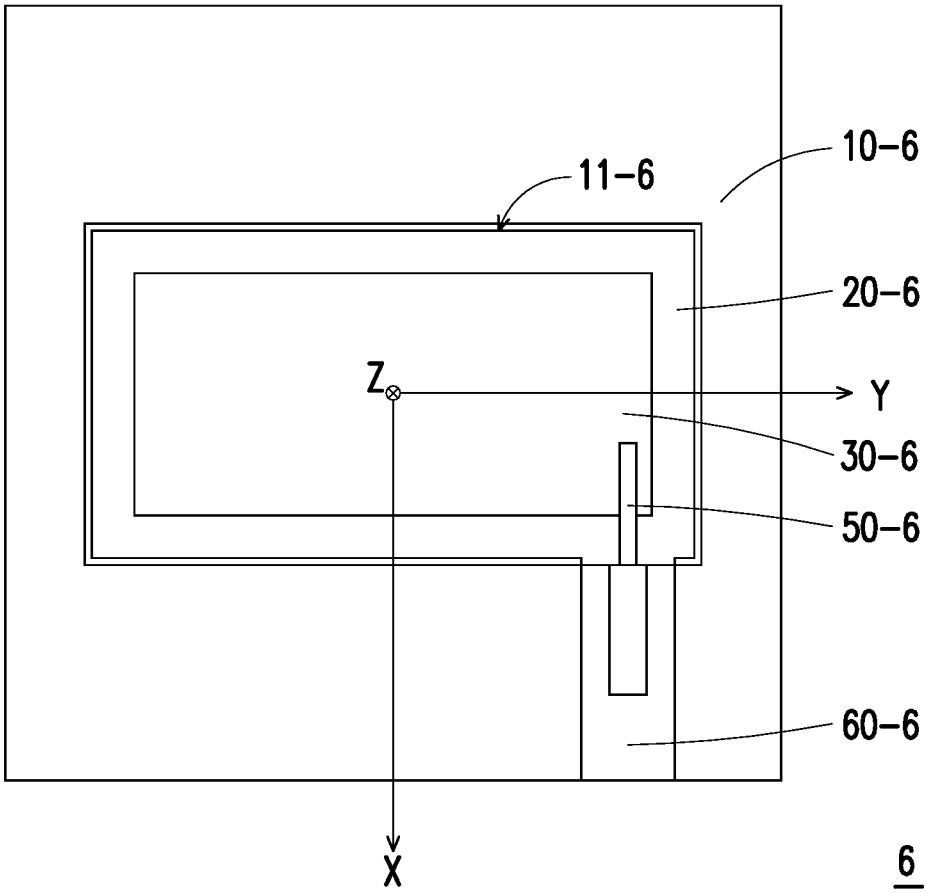
FIG. 6A is a top view of an antenna apparatus according to Embodiment 6 of the disclosure.
Figure 6B:
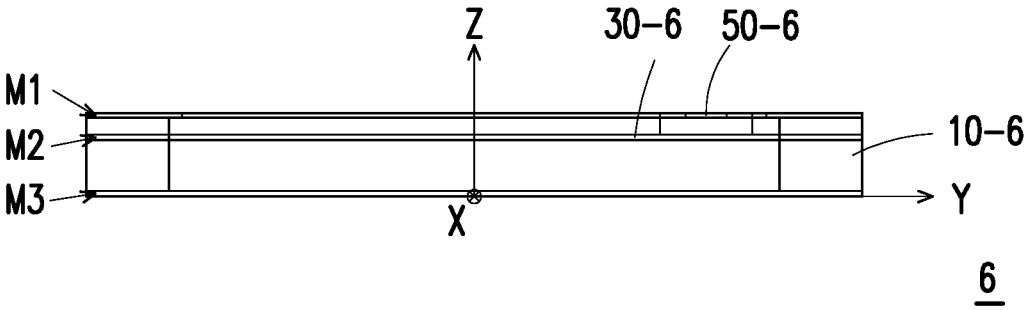
FIG. 6B is a side view of the antenna apparatus according to Embodiment 6 of the disclosure.

FIG. 6A is a top view of an antenna apparatus 6 according to Embodiment 6 of the disclosure, and FIG. 6B is a side view of the antenna apparatus 6 according to Embodiment 6 of the disclosure. Please refer to FIG. 6A and FIG. 6B. The antenna apparatus 6 includes a cavity element 10-6, a radiating element 30-6, and a feeding element 50-6. An outline of the radiating element 30-6 and an opening 11-6 form a surround slot 20-6. Similarly, from the perspective of FIG. 6B, the radiating element 30-6 is disposed at the conductive layer M2. The feeding element 50-6 is disposed at the conductive layer M1. However, the difference from Embodiment 5 is that the cavity element 10-6 further includes an opening extension part 60-6. The opening extension part 60-6 extends from the opening 11-6 to a corresponding space of the feeding element 50-6 to be accommodated by the feeding element 50-6.

It is worth noting that the design of the surround slot formed between the cavity element and the radiating element of the embodiments of the disclosure can generate two electric field modes with close frequencies, thereby achieving a non-narrowband. In addition, the feeding element of the embodiments of the disclosure is designed for shifted feeding, which also helps to increase the bandwidth.

Figure 7:
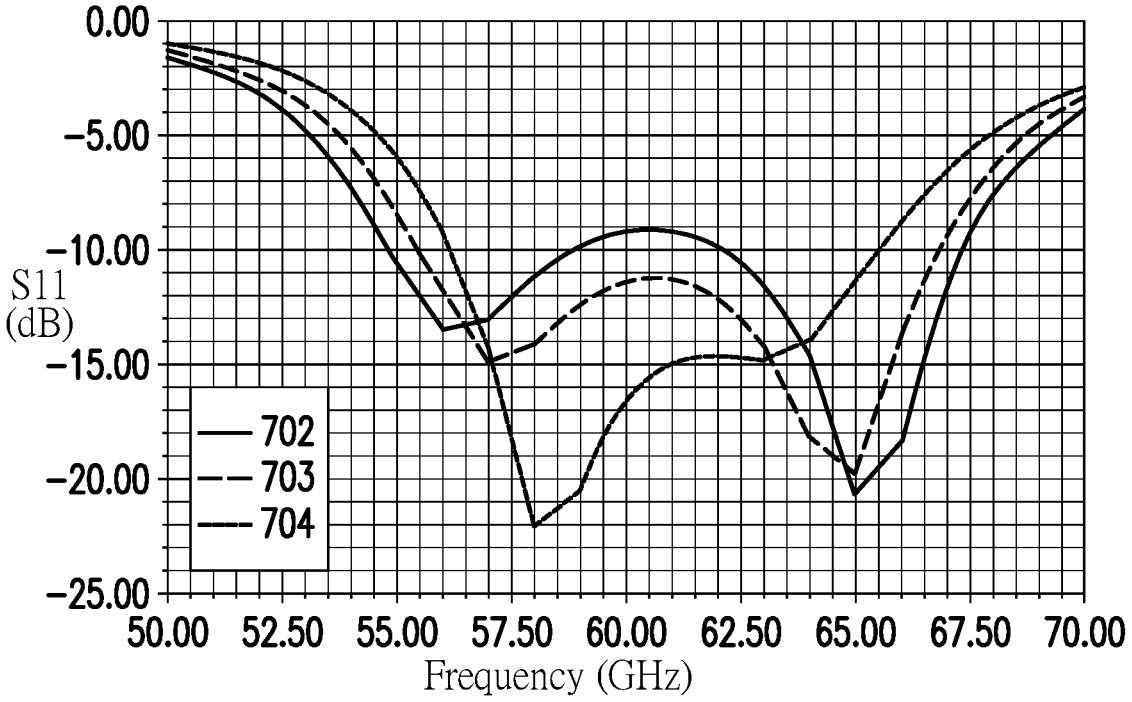
FIG. 7 is an S parameter diagram of the antenna apparatus according to Embodiment 1 of the disclosure.

FIG. 7 is an S parameter diagram of the antenna apparatus 1 according to Embodiment 1 of the disclosure. Please refer to FIG. 7. Corresponding shifting spacings of curves 702, 703, and 704 are different, wherein the shifting spacing corresponding to the curve 702 is the shortest, and the shifting spacing corresponding to the curve 704 is the longest. Take the bandwidth shown in the curve 703 as an example, compared with centered feeding, that is, the design without any shifting spacing, the bandwidth is increased from 3 GHz to 11 GHz. Therefore, if there is the shifting spacing, the bandwidth can be significantly increased.

Figure 8A:
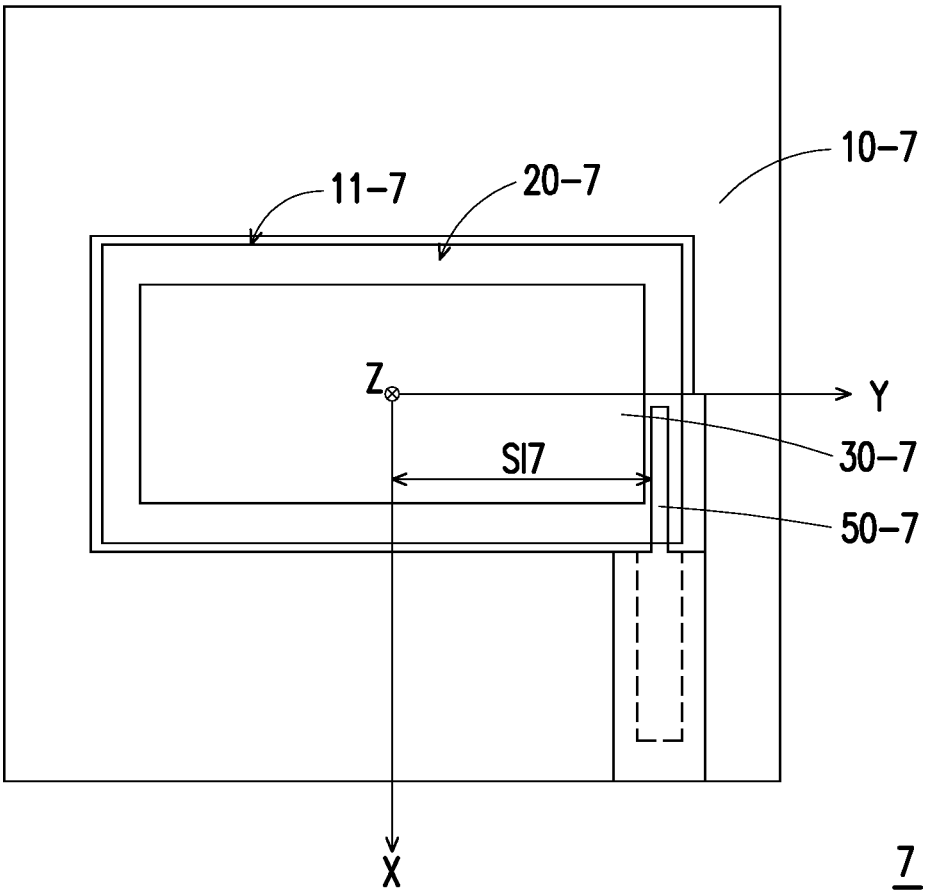
FIG. 8A is a top view of an antenna apparatus according to Embodiment 7 of the disclosure.

FIG. 8A is a top view of an antenna apparatus 7 according to Embodiment 7 of the disclosure. Please refer to FIG. 8A. The antenna apparatus 7 includes a cavity element 10-7, a radiating element 30-7, and a feeding element 50-7. An outline of the radiating element 30-7 and an opening 11-7 form a surround slot 20-7. The difference from Embodiment 1 is that a shifting spacing SI7 is greater than the shifting spacing SI1. A region of the feeding element 50-7 projected onto the conductive layer M1 in the vertical direction of the conductive layer M2 does not overlap with the radiating element 30-7, so that the feeding element 50-7 is exposed. In an embodiment, a region of the feeding element 50-7 projected onto the conductive layer M1 in the vertical direction of the conductive layer M2 partially overlaps with the radiating element 30-7, so that the feeding element 50-7 is partially exposed.

Figure 8B:
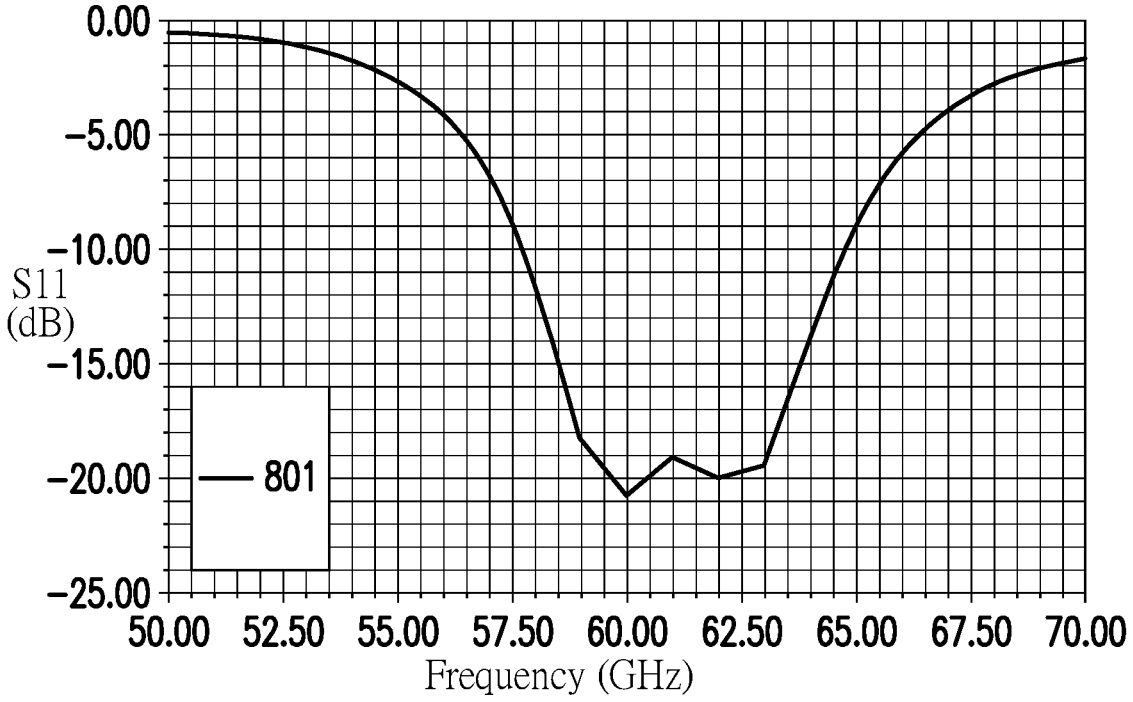
FIG. 8B is an S parameter diagram of the antenna apparatus according to Embodiment 7 of the disclosure.

FIG. 8B is an S parameter diagram of the antenna apparatus 7 according to Embodiment 7 of the disclosure. Please refer to FIG. 8B. Compared with FIG. 7, the bandwidth shown in a curve 801 is still greater than centered feeding. It can be seen that the user may adjust a length of the shifting spacing according to requirements to achieve the desired bandwidth.

Figure 9A:
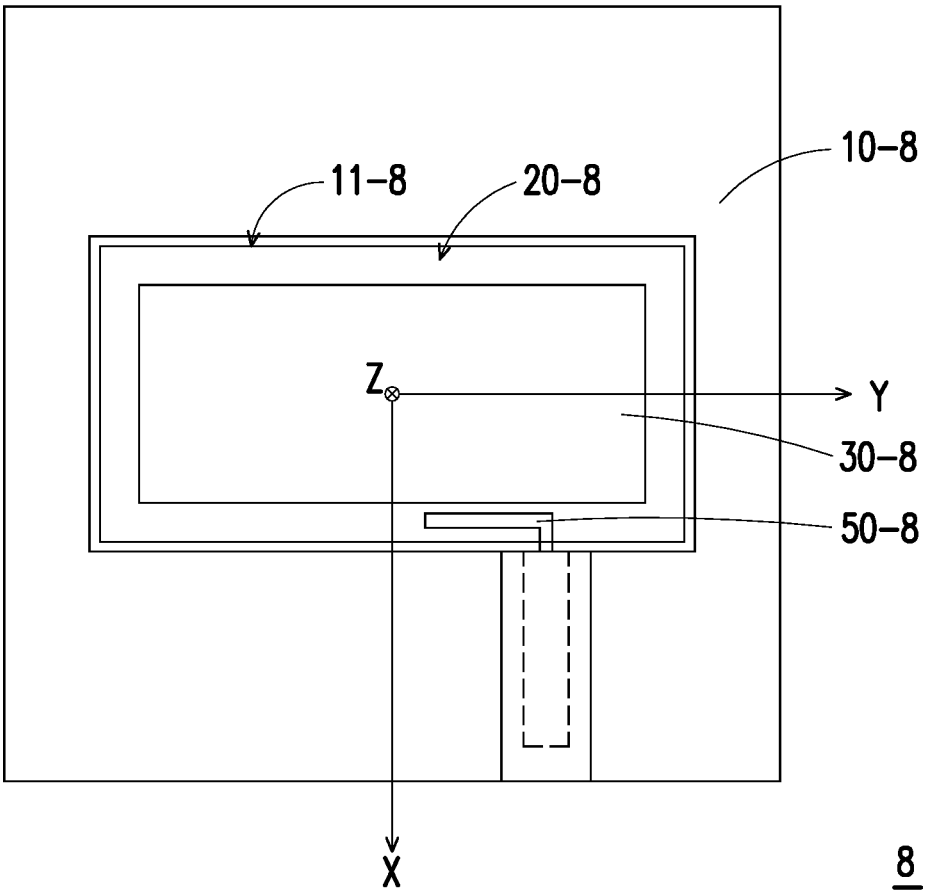
FIG. 9A is a top view of an antenna apparatus according to Embodiment 8 of the disclosure.

FIG. 9A is a top view of an antenna apparatus 8 according to Embodiment 8 of the disclosure. Please refer to FIG. 9A. The antenna apparatus 8 includes a cavity element 10-8, a radiating element 30-8, and a feeding element 50-8. An outline of the radiating element 30-8 and an opening 11-8 form a surround slot 20-8. The difference from Embodiment 1 is that the feeding element forms an L-shaped stub (a tail end thereof extends toward a central line (taking an axis X as an example) of the surround slot 20-8). In addition, a region of the feeding element 50-8 projected onto the conductive layer M1 in the vertical direction of the conductive layer M2 does not overlap with the radiating element 30-8, so that the feeding element 50-8 is exposed.

Figure 9B:
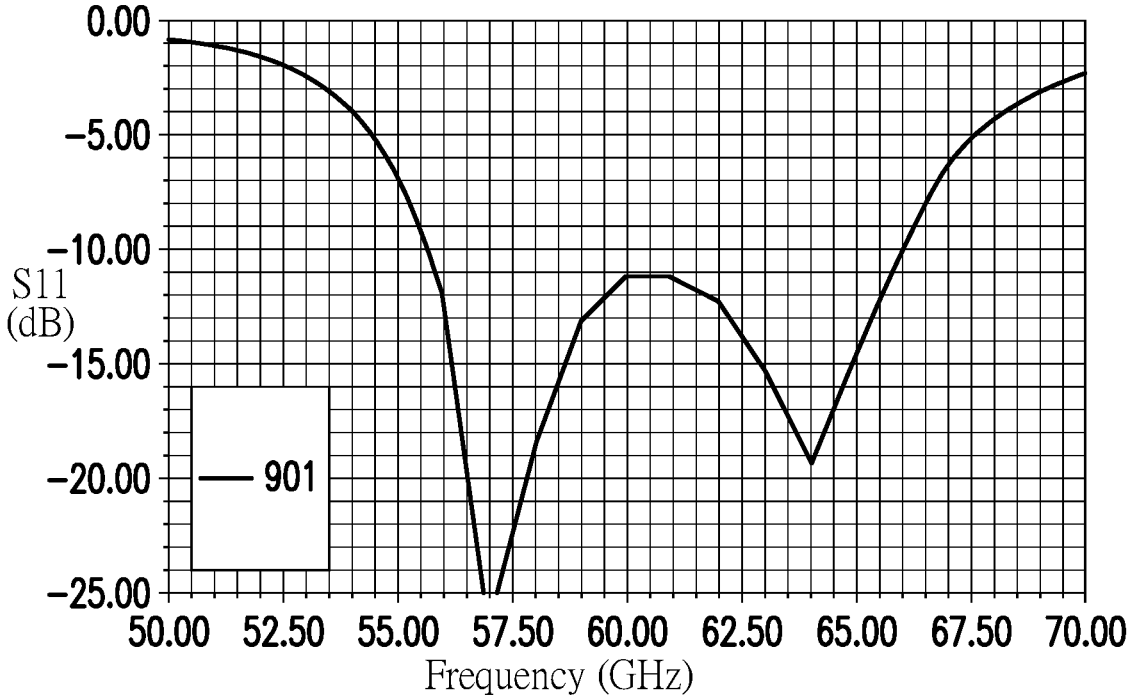
FIG. 9B is an S parameter diagram of the antenna apparatus according to Embodiment 8 of the disclosure.

FIG. 9B is an S parameter diagram of an antenna apparatus 8 according to Embodiment 8 of the disclosure. Please refer to FIG. 9B. A curve 901 as shown forms two obvious low points to provide a bandwidth greater than centered feeding.

Figure 10A:
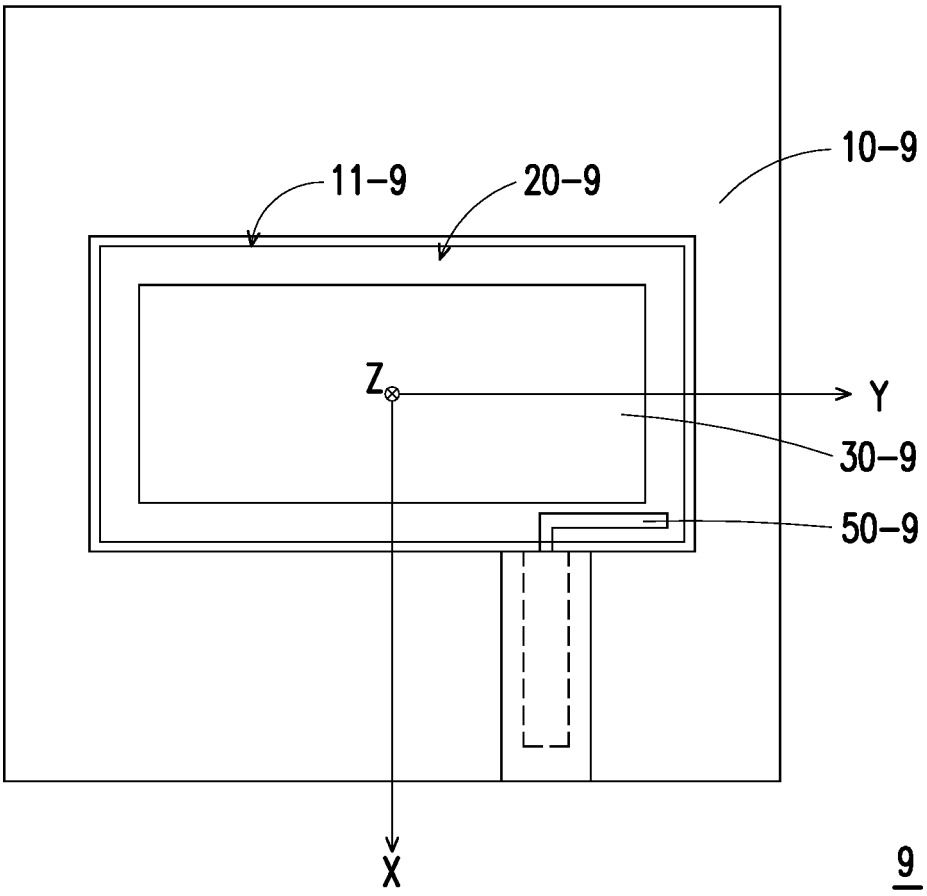
FIG. 10A is a top view of an antenna apparatus according to Embodiment 9 of the disclosure.

FIG. 10A is a top view of an antenna apparatus 9 according to Embodiment 9 of the disclosure. Please refer to FIG. 10A. The antenna apparatus 9 includes a cavity element 10-9, a radiating element 30-9, and a feeding element 50-9. An outline of the radiating element 30-9 and an opening 11-9 form a surround slot 20-9. The difference from Embodiment 1 is that the feeding element forms an L-shaped stub (a tail end thereof extends toward a direction away from a central line (taking the axis X as an example) of the surround slot 20-9). In addition, a region of the feeding element 50-9 projected onto the conductive layer M1 in the vertical direction of the conductive layer M2 does not overlap with the radiating element 30-9, so that the feeding element 50-9 is exposed.

Figure 10B:
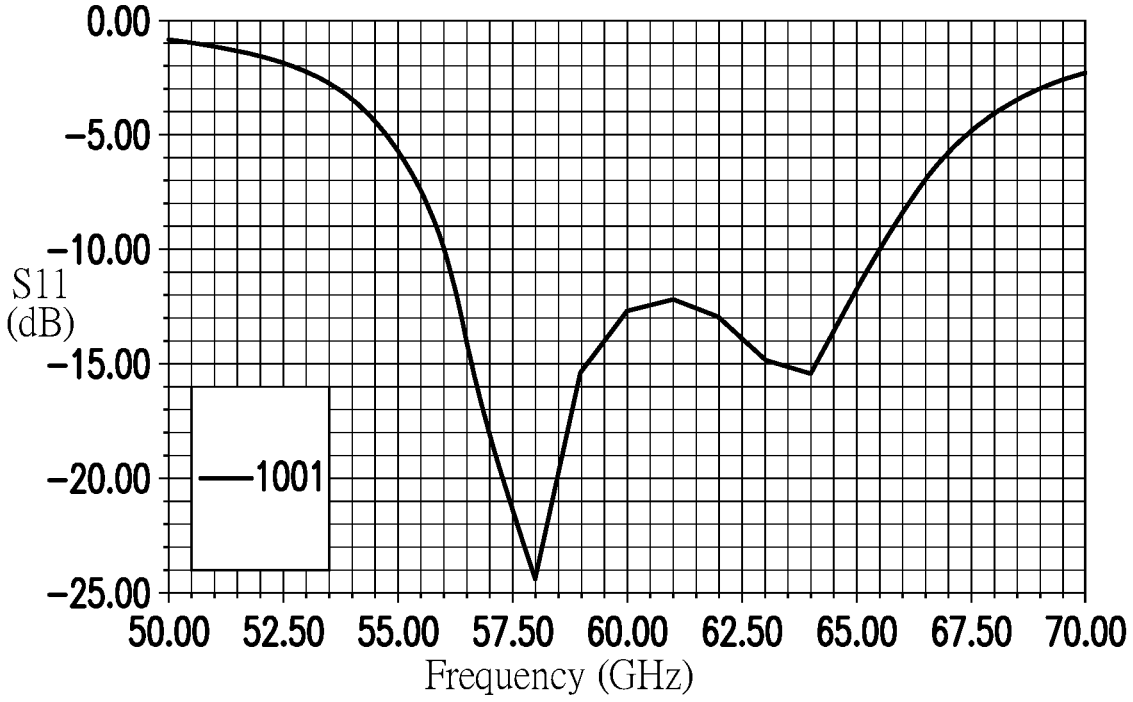
FIG. 10B is an S parameter diagram of the antenna apparatus according to Embodiment 9 of the disclosure.

FIG. 10B is an S parameter diagram of the antenna apparatus 9 according to Embodiment 9 of the disclosure. Please refer to FIG. 10B. A curve 1001 as shown forms two obvious low points to provide a bandwidth greater than centered feeding.

Figure 11A:
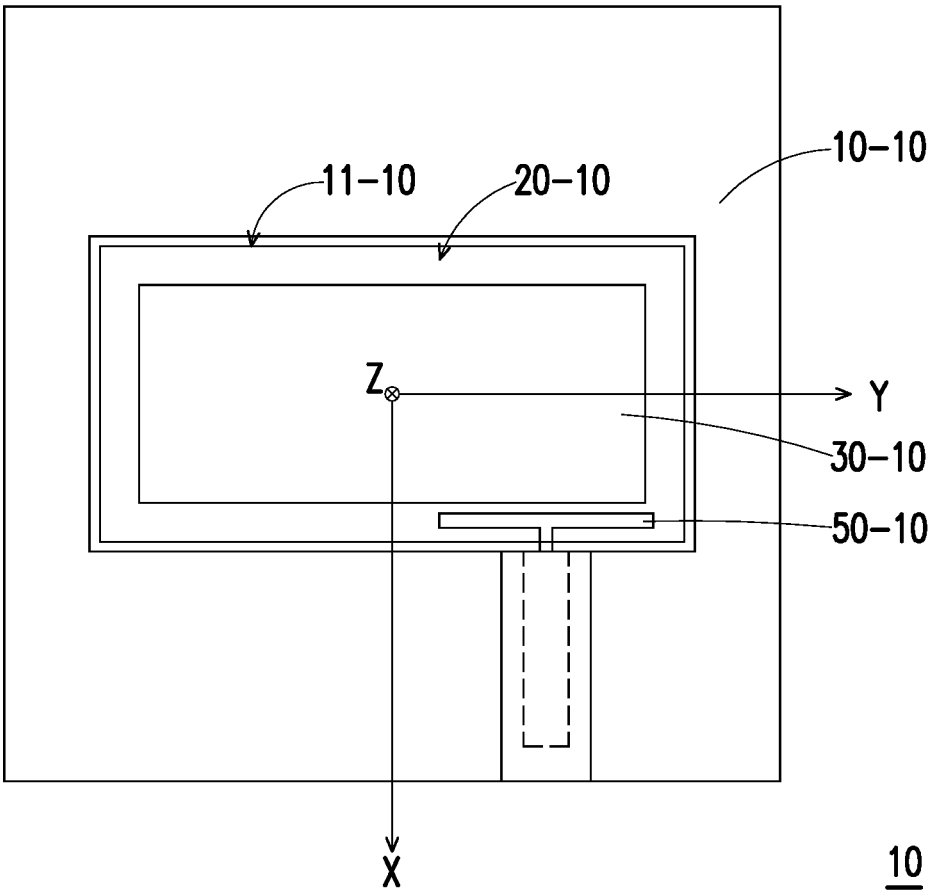
FIG. 11A is a top view of an antenna apparatus according to Embodiment 10 of the disclosure.

FIG. 11A is a top view of an antenna apparatus 10 according to Embodiment 10 of the disclosure. Please refer to FIG. 11A. The antenna apparatus 10 includes a cavity element 10-10, a radiating element 30-10, and a feeding element 50-10. An outline of the radiating element 30-10 and an opening 11-10 form a surround slot 20-10. The difference from Embodiment 1 is that the feeding element forms a T-shaped stub (two tail ends thereof respectively extend toward directions close to and away from a central line (taking the axis X as an example) of the surround slot 20-10). In addition, a region of the feeding element 50-10 projected onto the conductive layer M1 in the vertical direction of the conductive layer M2 does not overlap with the radiating element 30-10, so that the feeding element 50-10 is exposed.

Figure 11B:
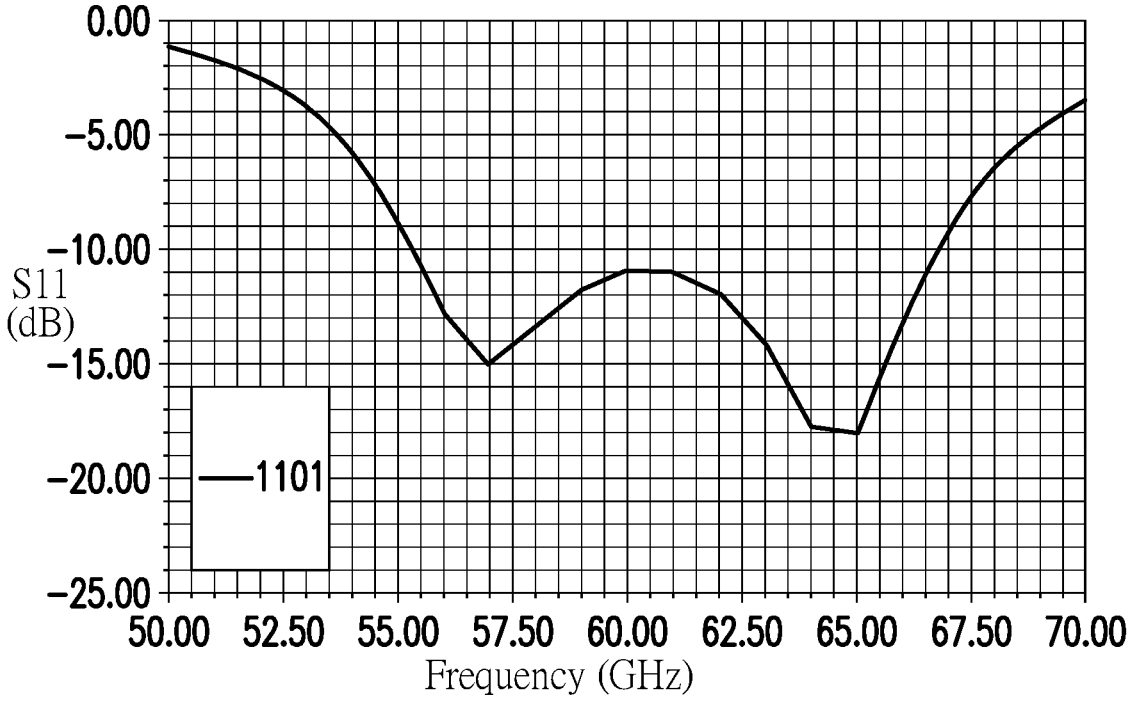
FIG. 11B is an S parameter diagram of the antenna apparatus according to Embodiment 10 of the disclosure.

FIG. 11B is an S parameter diagram of the antenna apparatus 10 according to Embodiment 10 of the disclosure. Please refer to FIG. 11B. A curve 1101 as shown forms two obvious low points to provide a bandwidth greater than centered feeding.

Figure 12:
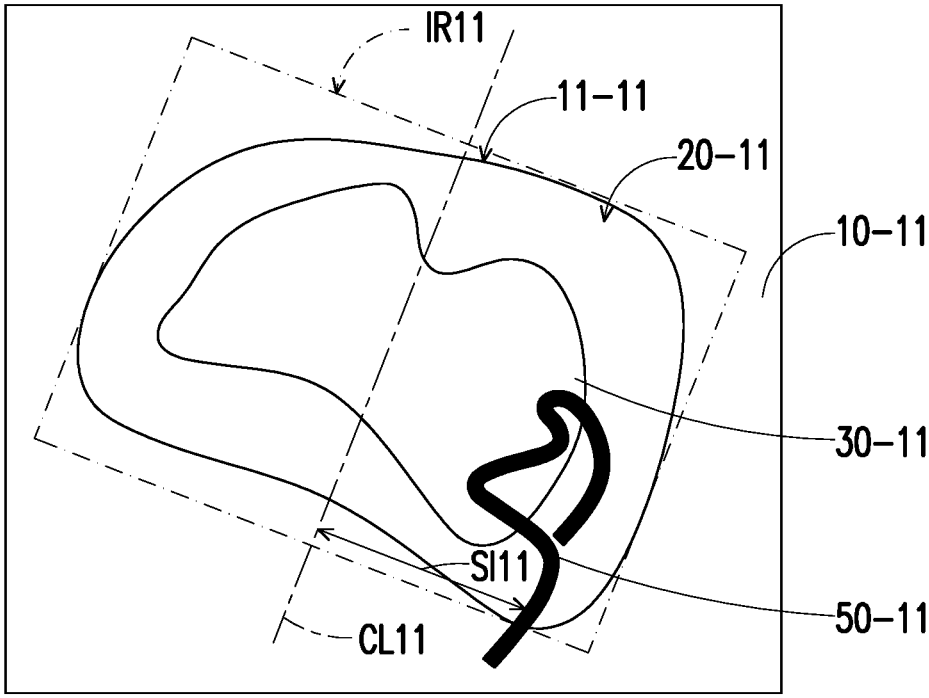
FIG. 12 is a top view of an antenna apparatus according to Embodiment 11 of the disclosure.

It should be noted that the outlines of the feeding element, the radiating element, and the opening of the above embodiments are all geometrical shapes. Of course, there may still be other changes in shapes. FIG. 12 is a top view of an antenna apparatus 11 according to Embodiment 11 of the disclosure. Please refer to FIG. 12. The antenna apparatus 11 includes a cavity element 10-11, a radiating element 30-11, and a feeding element 50-11. An outline of the radiating element 30-11 and an opening 11-11 form a surround slot 20-11. The difference from the above embodiments is that outlines of the radiating element 30-11, the feeding element 50-11, and the opening 11-11 are all irregular shapes. In any case, there is still a shifting spacing SI11 between an initial section of the feeding element 50-11 and a central line CL11 of an imaginary rectangle IR11 covering the surround slot 20-11. Therefore, compared with the antenna design of centered feeding, Embodiment 11 may provide a greater bandwidth.

In summary, in the antenna apparatus of the embodiments of the disclosure, the surround slot is formed between the cavity element and the radiating element, the feeding element feeds through electric field coupling, and there is the shifting spacing (that is, shifted feeding) between the feeding element and the central line of the imaginary rectangle. Therefore, parameters used in the antenna design of the embodiments of the disclosure are relatively simple and easy to optimize. The embodiments of the disclosure can increase the bandwidth, thereby achieving the non-narrowband (for example, the dual-bandwidth range, the multi-bandwidth range, or the wideband range). In addition, the embodiments of the disclosure are less susceptible to the influence of surrounding elements, and the degree of isolation between antenna elements is high.

Although the disclosure has been disclosed in the above embodiments, the embodiments are not intended to limit the disclosure. Persons skilled in the art may make some changes and modifications without departing from the spirit and scope of the disclosure. The protection scope of the disclosure shall be defined by the appended claims.

What is claimed is:

1. An antenna apparatus, comprising:

a cavity element, comprising an opening;

a radiating element, located in the opening and disposed at a first conductive layer, wherein an outline of the radiating element and the opening form a surround slot, an external outline of the surround slot is configured to define an imaginary rectangle, the imaginary rectangle has four sides respectively abutted against the external outline of the surround slot, and the imaginary rectangle comprises two first opposite sides; and a feeding element, disposed at a second conductive layer parallel to the first conductive layer and comprising:

a first section, wherein there is a coupling spacing between the first section and the radiating element to feed into the radiating element through electric field coupling, and a tail end thereof is an open circuit; and a second section, being an initial section of the feeding element inserted from one of the two first opposite sides into the opening, wherein there is a shifting spacing between the second section and a first central line of the imaginary rectangle.

2. The antenna apparatus according to claim 1, wherein the first central line is formed at a center of any one of the first opposite sides, and the tail end of the first section is not connected to other one of the two first opposite sides.

3. The antenna apparatus according to claim 2, wherein the shifting spacing is greater than or equal to one-sixteenth of a length of the first opposite side.

4. The antenna apparatus according to claim 2, wherein the imaginary rectangle further comprises two second opposite sides, the tail end of the first section does not exceed a second central line of the imaginary rectangle, and the second central line is formed at a center of any one of the second opposite sides.

5. The antenna apparatus according to claim 4, wherein a length of the first opposite side is greater than or equal to a length of the second opposite side.

6. The antenna apparatus according to claim 4, wherein the first section and the second section form a straight stub.

7. The antenna apparatus according to claim 6, wherein a region of the feeding element projected onto the first conductive layer in a vertical direction of the second conductive layer partially overlaps with the radiating element.

8. The antenna apparatus according to claim 6, wherein a region of the feeding element projected onto the first conductive layer in a vertical direction of the second conductive layer does not overlap with the radiating element.

9. The antenna apparatus according to claim 4, wherein the feeding element forms an L shape or a T shape, and a region of the feeding element projected onto the first conductive layer in a vertical direction of the second conductive layer does not overlap with the radiating element.

10. The antenna apparatus according to claim 1, wherein a shortest linear distance from the external outline of the surround slot to an external outline of the radiating element is configured to define one or more widths of the surround slot, and the width or a largest width among the widths is smaller than half of a wavelength of a radio signal of the antenna apparatus.

11. The antenna apparatus according to claim 1, wherein a geometrical shape of the outline of the radiating element is same as the opening.

12. The antenna apparatus according to claim 1, wherein a geometrical shape of the outline of the radiating element is different from the opening.

13. The antenna apparatus according to claim 1, further comprising:

a ground part, disposed at a third conductive layer parallel to the first conductive layer and located on a bottom side of the cavity element.

14. The antenna apparatus according to claim 13, wherein the second conductive layer is located between the first conductive layer and the third conductive layer.

15. The antenna apparatus according to claim 13, wherein the first conductive layer is located between the second conductive layer and the third conductive layer.

16. The antenna apparatus according to claim 13, wherein the cavity element is a conductor and is coupled to the ground part.

17. The antenna apparatus according to claim 1, wherein the radiating element comprises a patch.

18. The antenna apparatus according to claim 1, wherein the opening is defined by at least one conductive wall surrounding the radiating element.

19. The antenna apparatus according to claim 1, wherein the opening is defined by a plurality of parallel conductive vias surrounding the radiating element.

20. The antenna apparatus according to claim 19, wherein the feeding element is configured to transmit a radio signal, and a shortest distance between the plurality of conductive vias is less than or equal to half of a wavelength of the radio signal.

21. An antenna apparatus, comprising:

a cavity element, comprising an opening;

a radiating element, located in the opening and disposed at a first conductive layer, wherein an outline of the radiating element and the opening form a surround slot, an external outline of the surround slot is configured to define an imaginary rectangle, and the imaginary rectangle has four sides respectively abutted against the external outline of the surround slot; and a feeding element, disposed at a second conductive layer parallel to the first conductive layer and comprising:

a first section, wherein there is a coupling spacing between the first section and the radiating element to feed into the radiating element through electric field coupling, and a tail end thereof is an open circuit; and a second section, being an initial section of the feeding element inserted into the opening, wherein there is a shifting spacing between the second section and a first central line of the imaginary rectangle, and a region of the feeding element projected onto the first conductive layer in a vertical direction of the second conductive layer at least partially overlaps with the surround slot.

* * * * *